US006199628B1

(12) United States Patent
Beck et al.

(10) Patent No.: US 6,199,628 B1
(45) Date of Patent: Mar. 13, 2001

(54) DOWNHOLE FORCE GENERATOR AND METHOD

(75) Inventors: Harold Kent Beck, Copper Canyon; Alan Tancel Jackson; Clark Edward Robison, both of Plano; John Joseph Goiffon, Dallas, all of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/063,233

(22) Filed: Apr. 20, 1998

(51) Int. Cl.[7] ..... E21B 23/00

(52) U.S. Cl. ..... 166/53; 166/66.4; 166/66.7

(58) Field of Search ..... 166/381, 66.4, 166/66.7, 255.1, 53, 66

(56) References Cited

U.S. PATENT DOCUMENTS

| | | | | |
|---|---|---|---|---|
| 5,332,035 | * | 7/1994 | Schultz et al. | 166/53 |
| 5,358,035 | * | 10/1994 | Grudzinski | 166/53 |
| 5,492,173 | | 2/1996 | Kilgore et al. | 166/66.4 |
| 5,558,153 | * | 9/1996 | Holcombe et al. | 166/373 |
| 5,732,776 | * | 3/1998 | Tubel et al. | 166/250.15 |
| 5,868,201 | * | 2/1999 | Bussear et al. | 166/53 |
| 5,906,238 | * | 5/1999 | Carmody et al. | 166/53 |

OTHER PUBLICATIONS

"DPU® Downhole Power Unit System—Economical and Dependable Setting and Retrieving for Downhole Tools," Halliburton Company (1997) (document itself not admitted to be prior art but it discloses a prior Downpole Power Unit system).

"SPE 26063—New Electronic Measurement System Enhances Slickline Service Capabilities," Larimore et al., Society of Petroleum Engineers (1993).

"OTC 7877—A Battery–Operated, Electro–Mechanical Setting Tool for Use with Bridge Plugs and Similar Wellbore Tools," Gazda et al., Offshore Technology Conference (1995).

"SPE 35236—Low Cost Solutions for Well Interventions Through Advanced Slickline Services," Larimore et al., Society of Petroleum Engineers (1996).

"Low–Cost Well Interventions With Slickline," Live–Well Intervention (Feb. 1997).

"World Expro 1996—The International Review of Hydrocarbon Exploration and Production Technology," Sterling Publications Limited, article entitled "Slickline setting tool increases safety and reduces setting time for packers and bridge plugs" (1995).

* cited by examiner

*Primary Examiner*—David Bagnell
*Assistant Examiner*—Zakiya Walker
(74) *Attorney, Agent, or Firm*—Paul I. Herman; E. Harrison Gilbert, III

(57) ABSTRACT

A downhole force generator includes a longitudinal force generating and transmitting assembly (including, for example, a motor and a threaded shaft that is extended and retracted by operation of the motor) adapted to be moved into a well. A controller is also adapted to be moved into the well and is connected to the longitudinal force generating and transmitting assembly. The controller includes a memory containing a program to control the longitudinal force generating and transmitting assembly to obtain at least one desired operating condition in the well. A sensor can be connected to the controller. A self-contained power source adapted to be moved into the well can also be used. A method of providing an infinitely variable linear force in an oil or gas well is a particular application for such a downhole force generator. This particular method comprises sensing in the well a parameter responsive over a continuum to changes in a selected operating condition in the well. This method further comprises actuating a microcontroller to run a predetermined program stored in the microcontroller. The program is run to obtain a specific state of the selected operating condition represented within the continuum of the sensed parameter.

19 Claims, 4 Drawing Sheets

DOWNHOLE FORCE GENERATOR AND METHOD

BACKGROUND OF THE INVENTION

This invention relates generally to force generators and force generating methods used downhole in a well, such as an oil or gas well. A particular aspect of the invention is its automated control which enables varying degrees of different states of operation to be obtained. For example, a particular embodiment of the invention provides for variable control of fluid flow through an "infinitely" variable choke that is operated across a continuum of "openness" or "closedness" as distinguished from merely one open state and one closed state.

Although the present invention can be used in any type of borehole in which the usefulness of the invention is needed, it will be described with reference specifically to an oil or gas well. In drilling, testing, completing and producing such a well, many different types of equipment can be used in the well. Some of this equipment is operated by a force applied to the equipment. For example, a valve is one type of equipment typically used in an oil or gas well, and a force typically needs to be applied to the valve member to rotate or slide it between fully closed and fully open positions.

Different types of forces may be needed to accomplish the foregoing. One example is a hydraulic force exerted by a fluid under pressure. Another example, and the one relevant to the present invention, is a mechanical force exerted by one structural body moved relative to another structural body. Such force can act in different directions. In a preferred embodiment of the present invention, the force acts longitudinally relative to the well. An example of a longitudinally acting force generating apparatus is shown in U.S. Pat. No. 5,492,173 to Kilgore et al.

A shortcoming of the apparatus disclosed in the Kilgore et al. patent is that it does not have the ability to variably control itself. The Kilgore et al. apparatus provides a longitudinal force to operate a device down in a well; however, the Kilgore et al. patent does not disclose a programmed downhole controller to control the apparatus across a continuum, or to different degrees, of one or more general states. With regard to fluid flow, this control is desirable such as for obtaining different flow rates or for maintaining a constant flow rate even as a flow control orifice of the downhole device being operated deteriorates because of an abrasive fluid flowing through it. Thus, there is the need for a downhole force generator and a downhole force generating method by which variable control of a downhole operated device can be obtained. Preferably such control should be obtained automatically, such as to implement a single event or a preprogrammed sequence, and at relatively low cost.

SUMMARY OF THE INVENTION

The present invention overcomes the above-noted and other shortcomings of the prior art, and satisfies the aforementioned needs, by providing a novel and improved force generator and force generating method. The present invention achieves variable control of a downhole operated device. This preferably occurs automatically by a programmed controller operating a downhole power unit through which the force is generated.

Other intended advantages of the invention include: more reliability than obtained from manipulating a carrier wire; less surface force required from wire spool operating equipment; less sophistication required in the knowledge of the person operating the surface equipment; greater force generation downhole than with conventional slickline operations; and less significant effect by depth of the tool since the carrier wire need only be used to position the tool string.

Although not limited in its broadest sense to longitudinal force, the preferred embodiment of the present invention is a downhole longitudinal force generator. This downhole longitudinal force generator comprises: a longitudinal force generating and transmitting assembly adapted to be moved into a well, and a controller adapted to be moved into the well and connected to the longitudinal force generating and transmitting assembly. The controller includes a memory containing a program to control the longitudinal force generating and transmitting assembly to obtain at least one desired operating condition in the well. The downhole longitudinal force generator can also comprise a sensor connected to the controller. The downhole longitudinal force generator can further comprise a self-contained power source adapted to be moved into the well.

In a particular implementation, the longitudinal force generating and transmitting assembly includes an electric motor and a jackscrew assembly. The motor includes a rotor, and the motor is responsive to control from the controller. The jackscrew assembly includes a rotational member connected to the rotor, and it further includes a translational member. The translational member engages the rotational member such that rotation of the rotational member moves the translational member longitudinally relative to the rotational member.

The present invention also includes a method of providing a linear force in an oil or gas well. This particular method comprises sensing in the well with a detector a parameter responsive over a continuum to changes in a selected operating condition in the well. This includes generating with the detector electrical signals representing the sensed parameter. This method further comprises actuating a microcontroller, located in the well and connected to the detector in the well, to run a predetermined program stored in the microcontroller and running the program to obtain a specific state of the selected operating condition represented within the continuum of the sensed parameter. This includes connecting a power source disposed in the well with the microcontroller to initiate continuous linear movement of a first body relative to a second body, wherein the first and second bodies are disposed in the well with the microcontroller and the power source; continuously processing electrical signals received from the detector and determining where within the continuum the sensed parameter is; and disconnecting the power source to stop the linear movement of the first body relative to the second body when it is determined that the sensed parameter is at the point in the continuum corresponding to the specific state of the selected operating condition. This method can further comprise fixing the second body in position relative to either the well or an object in the well.

Therefore, from the foregoing, it is a general object of the present invention to provide a novel and improved force generator and force generating method. Other and further objects, features and advantages of the present invention will be readily apparent to those skilled in the art when the following description of the preferred embodiments is read in conjunction with the accompanying drawings.

DETAILED DESCRIPTION OF THE INVENTION

Preferred embodiments of a downhole force generator of the present invention will be described with reference to FIGS. 1–5. A particular implementation will then be described with reference to FIGS. 6 and 7.

Figure 1:
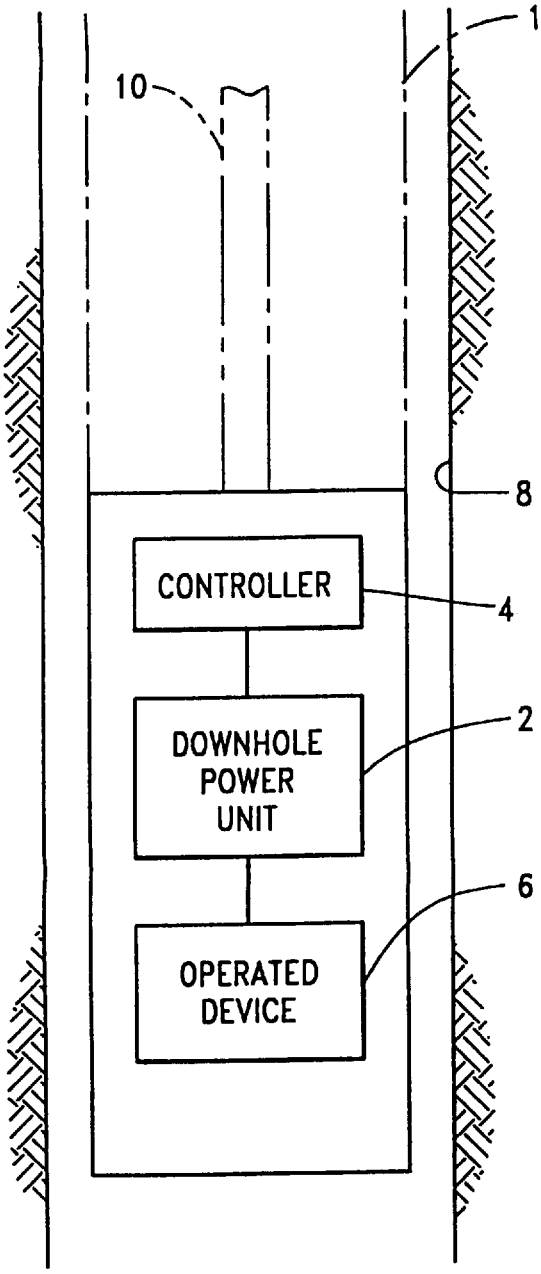
FIG. 1 is a block and schematic illustration depicting a downhole force generator of the present invention disposed in a well.

Referring to FIG. 1, the downhole force generator includes a downhole power unit 2 which is operated by a controller 4 to move one or more parts of an operated device 6. The downhole power unit 2, the controller 4 and the operated device 6 are illustrated in FIG. 1 as part of a tool string illustrated as having been lowered by conventional means into a well 8, such as an oil or gas well. The well 8 can be either an open borehole or a cased or lined hole. The tool string can also be disposed inside of an outer string which itself is located in the well 8.

The tool string conveyed into the well 8 can be of any suitable type. Examples illustrated in FIG. 1 include a wireline, a slickline or coiled tubing exemplified by the reference numeral 10 in FIG. 1 or a pipe or tubing string represented by the reference numeral 12 in FIG. 1.

Before describing the downhole power unit 2 and the controller 4 in more detail, the operated device 6 will be described. The operated device 6 is not a part of the present invention but rather is the workpiece operated upon by the invention. As such, it can be any suitable device adapted to receive the force generated and transmitted by the present invention. Examples of particular devices 6 include plugs, locks, infinitely variable chokes, sliding sleeves, and, in general, valves which can be operated by a linear motion. These devices, and others, can be ones which are used in any of the various operations of drilling, testing, completing or producing a well.

Figure 2:
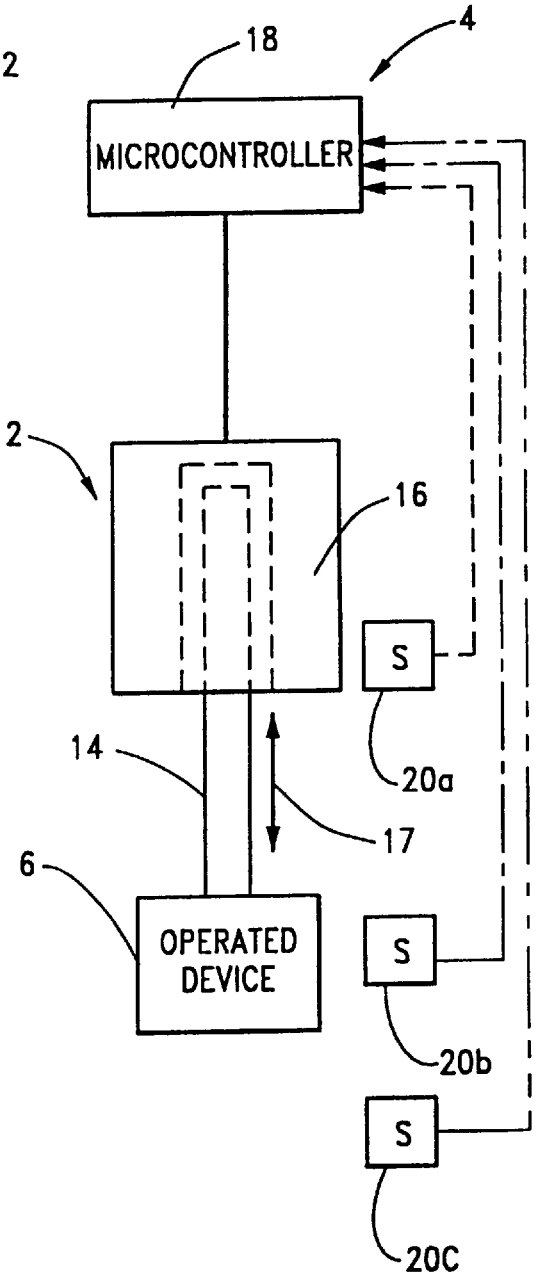
FIG. 2 is a block and schematic illustration of preferred embodiments of the downhole force generator.

Referring to FIG. 2, the downhole power unit 2 of the preferred embodiment comprises a longitudinal force generating and transmitting assembly adapted to be moved into the well. As illustrated in FIG. 2, the assembly includes a first body 14 and a second body 16 connected to the first body 14 such that the first body 14 is moveable relative to the second body 16. The first body 14 is shown as a translational member which can move linearly and longitudinally in two directions relative to the second body 16 as indicated by arrows 17. The second body 16 is typically fixed in position relative to either or both of the operated device 6 or the well 8 (the device 6 is depicted in FIGS. 1 and 2, and the well 8 is depicted in FIG. 1). For example, the body 16 can abut part of the device 6 so that the body 16 is thereby fixed relative to the device 6, or the body 16 can include a mechanism (e.g., slips, keys, or dogs) that engages the well 8 or an outer string to fix the body 16 relative thereto.

As will be subsequently described in more detail with regard to FIGS. 6 and 7, the second body 16 of a particular implementation includes an elongated housing, a motor disposed in the housing, and a sleeve connected to a rotor of the motor. The sleeve is a rotational member that rotates with the rotor. In this implementation, the translational member or first body 14 is a threaded shaft received within the threaded interior of the sleeve or rotational member of the second body 16. Operation of the motor by the controller 4 rotates the sleeve which causes the threaded shaft to move longitudinally relative to a predetermined reference position, such as defined by the body 16.

Still referring to FIG. 2, the controller 4 is preferably a microcontroller 18 made of suitable electrical components to provide miniaturization and yet durability within the high pressure, high temperature environments which can be encountered in an oil or gas well. Suitable such components are known in the art. The microcontroller 18 is responsive to one or more sensors 20.

The controller 4, of whatever implementation, is adapted to be moved into the well 8 and connected to the longitudinal force generating and transmitting assembly in a suitable manner. For example, the microcontroller 18 embodiment can be housed within the structure of the downhole power unit 2, or it can be connected outside of the unit but within the tool string moved into the well. The microcontroller 18 can be disposed in the first body 14 or the second body 16. In whatever physical location the controller 4 is disposed, it is operationally connected to the downhole power unit 2 to actuate movement of the first body 14 relative to the second body 16 and to stop movement of the first body 14 relative to the second body 16 when a desired state of operation is obtained. A non-limiting example of such a desired state is an opened or closed state of a valve. It is a particular advantage of the microcontroller 18 embodiment that "infinite" control of the desired state can be obtained so that with regard to a valve, for example, different degrees of "openness" or "closedness" can be obtained with the present invention.

Figure 3:
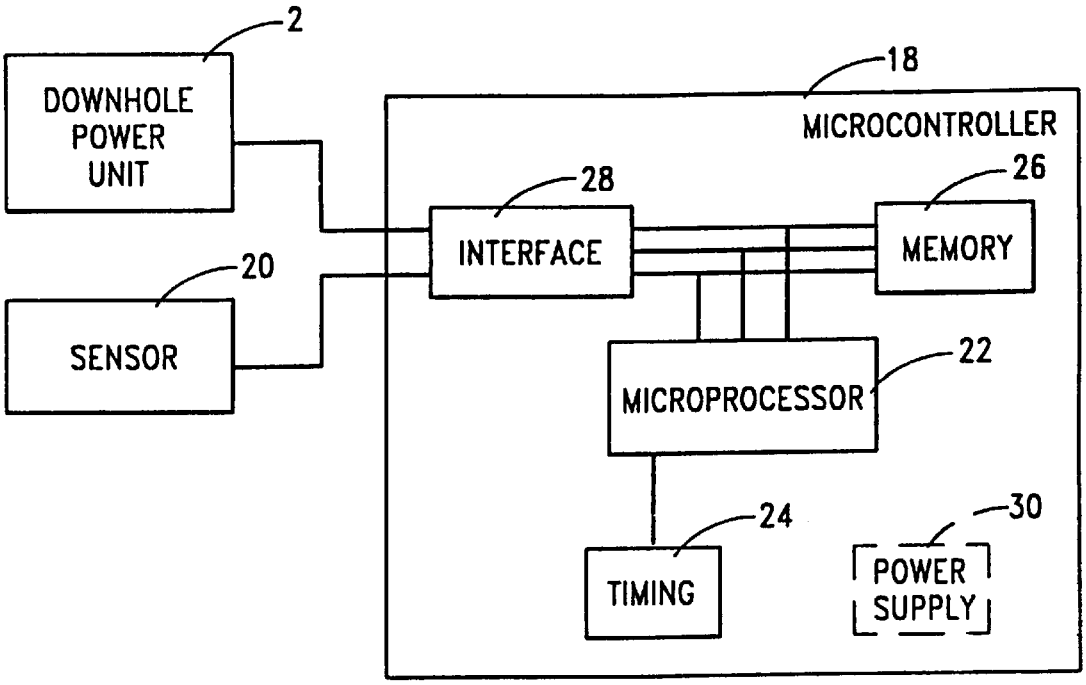
FIG. 3 is a block and schematic illustration of a preferred embodiment of a microcontroller of the embodiments of FIG. 2.

Referring to FIG. 3, the microcontroller 18 includes a microprocessor 22 which operates under control of a timing device or circuit 24 and a program stored in a memory 26. The program in the memory 26 includes instructions which cause the microprocessor 22 to control the downhole power unit 2 through an interface 28 (e.g., a relay or an electrical switch). The components of the microcontroller 18 are of known types and are connected in a known manner given particular types of components used.

The microcontroller 18 operates under power from a power supply which can be at the surface of the well or, preferably, contained within the microcontroller 18, the downhole power unit 2 or otherwise within the downhole portion of the tool string of which these components are a part. The self-contained power supply 30 shown in FIG. 3 is preferably adapted to be moved into the well. This power source provides electrical power to at least one, and preferably both, of the longitudinal force generating and transmitting assembly and the controller of the present invention. For a particular implementation, the power source 30 provides the electrical power to both the motor of the downhole power unit 2 and the microcontroller 18 of the controller 4. By way of example, the power supply 30 can be the power supply of the downhole power unit 2 described in more detail below with reference to FIGS. 6 and 7.

Figure 4:
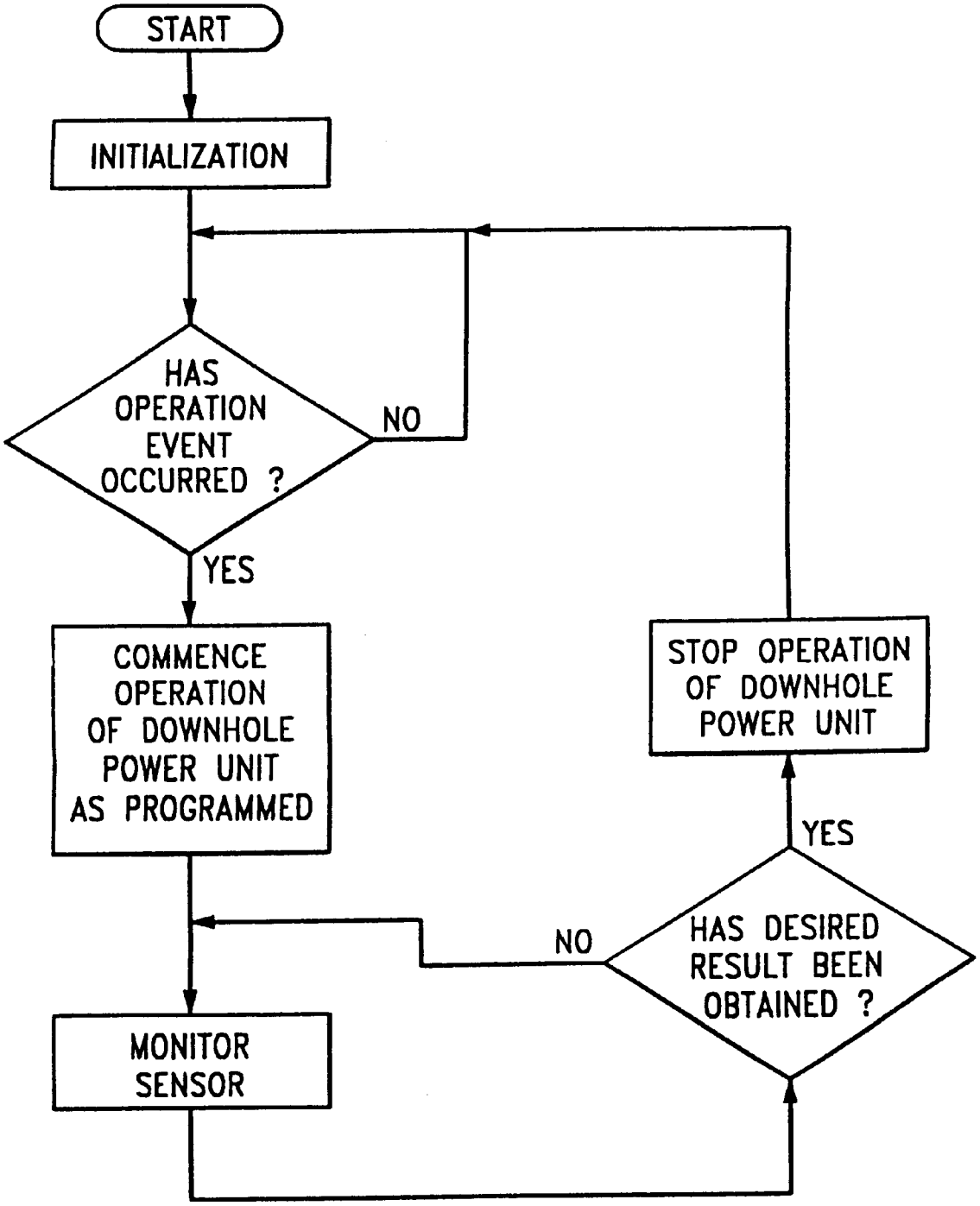
FIG. 4 is a flow diagram of a program for the microcontroller.

Referring to FIG. 4, an example of a program stored in the memory 26 is illustrated. The first illustrated action is initialization, such as to operate the operated device 6 to a beginning or known state. For a valve, this can be to either a fully opened position or a fully closed position or to some identifiable intermediate position. Other initialization (e.g., system testing) can be performed.

Once initialized, the program causes the microcontroller 18 to determine whether an operation event has occurred. One example is whether a predetermined timeout period has expired. Another example is whether a predetermined condition of the well environment is sensed (e.g., a bottom hole pressure, an annulus pressure, a temperature, a formation characteristic, a fluid characteristic). Still another example is whether a control signal has been received from the surface (e.g., an electrical signal sent through a wireline, an acoustical signal sent through a tubing string or fluid inside or outside the tubing string, a pressure signal sent through a fluid in the tubing string or in the well, a signal sent via a fiberoptic cable, or an electromagnetic signal transmitted through the earth). Such a transmitted control signal can come from a surface unit (not shown) that sends a suitably addressed or otherwise recognizable command.

If the operation event has occurred, the microcontroller 18 commences operation of the downhole power unit as programmed. With regard to controlling a motor that operates a sleeve receiving the translational member 14 as referred to above, this includes energizing the motor to rotate the sleeve in the desired direction to either extend or retract the translational member 14. The sensor 20 monitors this operation and provides responsive signals to the microcontroller 18. When the microcontroller 18 determines that a desired result has been obtained, it stops operation of the downhole power unit, such as by de-energizing the motor of the exemplified implementation. Once operation has stopped, the program returns to its status where it monitors for whether an operation event has occurred.

In operating the downhole power unit to obtain the desired result, the microcontroller 18 can operate in any suitable manner. Two examples include (1) using look-up tables or (2) using equations to determine whether the desired result has been obtained. Either of these can be used to provide control for a single event or for multiple events, such as a sequence of events, for example. With regard to a look-up table implementation, a table of data is programmed in the memory 26. As each reading from the sensor 20 is taken by the microcontroller 18, the microcontroller 18 looks up in the table the corresponding state indicated by the signal from the sensor. With regard to an infinitely variable choke implementation, this condition could correspond to, for example, the position of the shaft 14, or the percent of "openness" of the choke, or the flow rate controlled by the choke.

With regard to the equation implementation, the memory 26 is programmed with one or more equations to calculate data specifying the state indicated by the signal read by the microcontroller 18 from the sensor 20. For example, the microcontroller 18 can be programmed to read that a first predetermined signal from the sensor 20 indicates that the translational member 14 is at one end of its travel and thus the operated device 6 is at one extreme state. In this example, the microcontroller 18 can also be programmed to recognize that a different predetermined signal read from the sensor 20 indicates that the translational member 14 is at the other end of its longitudinal travel and that the operated device is at its other extreme state. The microcontroller 18 can further be programmed with the interpolation relationship (e.g., linear) of the signals from the sensor 20 and the two predetermined signals referred to above. With this information, the microcontroller 18 is able to read a signal from the sensor 20 and calculate where between the two extremes the translational member 14 is located as indicated by the respective sensor signal.

The foregoing can be programmed such that the downhole power unit 2 can be operated over a variable range. For example, with a motor implementation, the microcontroller 18 can be programmed to operate the motor at variable speeds to slow it down or speed it up in addition to simply turning it on or off or reversing direction.

Figure 5:
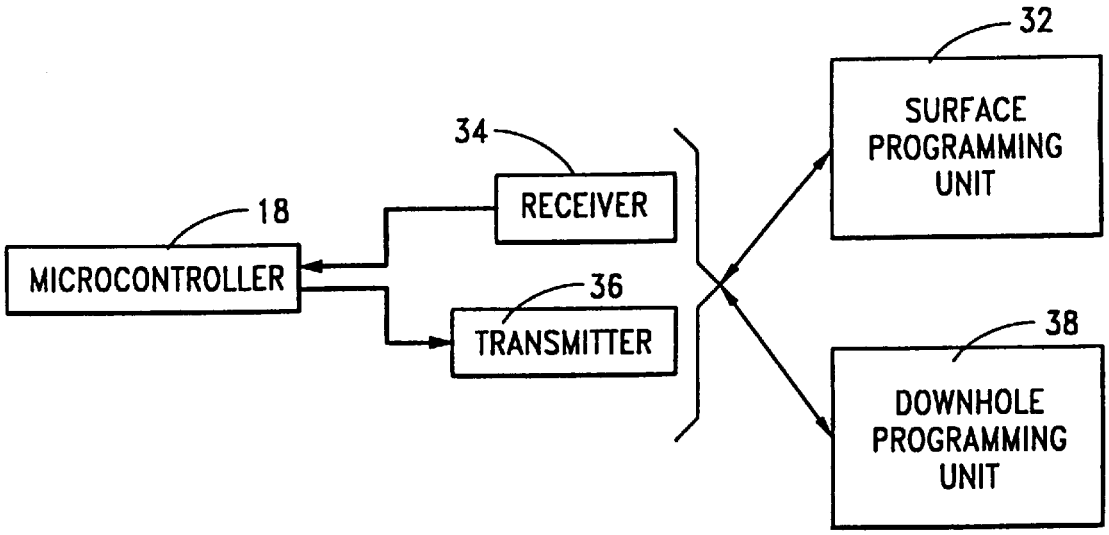
FIG. 5 is a block diagram illustrating two programming techniques for the microcontroller.

Regarding the programming of the microcontroller 18, this can be done at the surface or downhole as illustrated in FIG. 5. For surface programming, a surface programming unit 32 can be mechanically plugged into the microcontroller 18 or it can be connected by electromagnetic or optical signals which are received and transmitted by a suitable receiver 34 and transmitter 36 connected to the microcontroller 18. A downhole programming unit 38 can be similarly used. The downhole programming unit 38 can be lowered into the well separately from the tool string containing the downhole power unit 2, the controller 4 and the operated device 6, but into proximity with the microcontroller 18 for communicating through the receiver 34 and the transmitter 36. As with the surface programming unit 32, this communication can be through mechanical coupling or by electromagnetic or optical signaling, for example.

The microcontroller 18 can be programmed with specific data to adapt it to any particular application. For example, the overall program can be stored in the microcontroller with merely numerical data needing to be entered for any particular job. For example, if a variable choke is to be operated specifically to a sixty-three percent open condition, the number "63" is entered if the program is so adapted to receive this type of input. Other types of input data can be used as well, such as entering a sequence of states to be obtained, or entering complete program code for some or all of the operating program in the memory 26.

Referring to the sensor 20 of the present invention, it can be of any suitable type which is responsive to some parameter having a correspondence with the desired operating condition in the well. More than one sensor can be used.

With regard to the nature of the sensor, it can be one which responds to the position of the translational member relative to the second body 16. This sensor is represented by sensor 20*a* in FIG. 2. For example, this can include an optical or acoustical sensor which senses the time between transmitting an optical or acoustical signal and receiving a reflection of it from a polished end surface of the translational member 14 movably located relative to a position of the sensor fixed to the second body 16.

Another example of the sensor 20*a* is one which senses the number of revolutions of the threaded shaft implementation of the translational member 14. Such a sensor operates in combination with the program of the microcontroller 18 that is initialized with the initial position of the translational member 14 and with the total number of revolutions it takes from that initial location to reach either the extreme extension position or the extreme retraction position of the translational member 14. By counting the revolutions and using it with the initialized position data, the microcontroller determines the state of operation of the device 6. The sensor 20*a* can also include a current sensor to sense the load current of the motor operating the sleeve which causes the extension or retraction of the translation member 14.

Still another example of the sensor 20*a* is a tuned system wherein the translational member 14 varies the capacitance or inductance of the tuned system by the different amount of the translational member 14 which is within the cavity of the second body 16 into which the translational member 14 is extended from or retracted into.

The sensor 20 can also include a sensor 20*b* (FIG. 2) which senses the position or state of operation of the operated device 6 connected to the translational member 14. The sensor 20*b* includes types that can detect changes in position of one member relative to another given a specific operated device 6. For example, if the device 6 is a valve, the sensor 20*b* can be of the type that senses changes in the position of the valve element relative to the valve body.

Still further, the sensor can be the sensor 20*c* (FIG. 2) which responds to the condition that results from operation of the operated device 6. For example, if the operated device is a valve, the sensor 20*c* can be a flow meter which senses the flow that responds to the state of the valve. The sensor 20*c* thus responds to an environmental parameter in this illustration. Non-limiting examples of other environmental parameters that can be sensed are pressure, temperature, a characteristic of fluid, and strain in a tool.

Another type of sensor that can be used is one which enables the location of the tool in the well to be determined. This is desirable for confirming that the operation of the tool occurs at the correct location, and with the correct downhole device. This type of sensor would typically be used in addition to the aforementioned sensor 20, and can be of a type known in the art. A strain gauge would also be acceptable.

Figure 6:
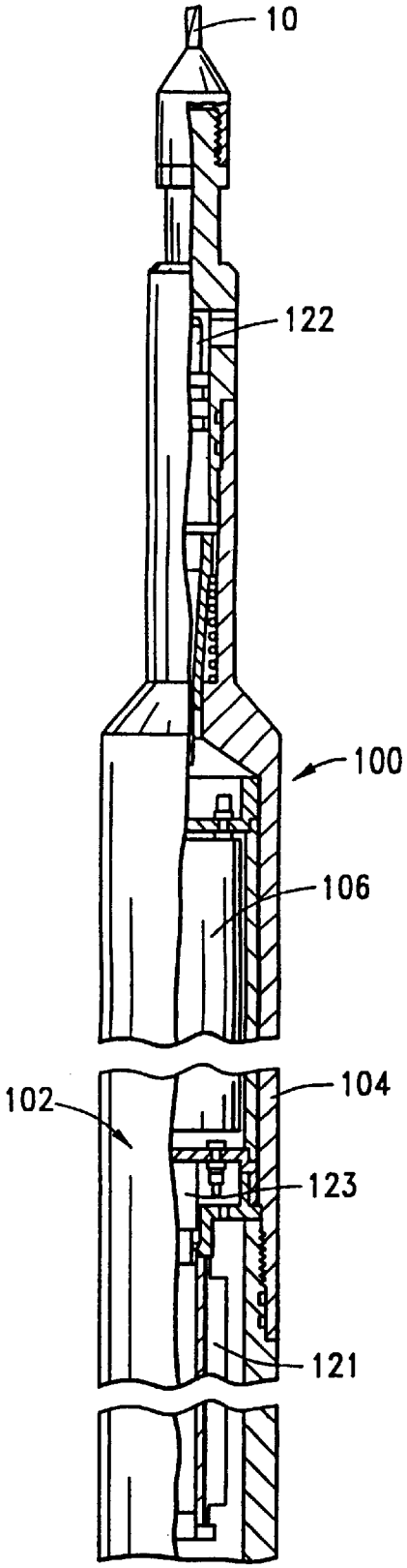
FIGS. 6 and 7 form a partial vertical section of a particular implementation of the downhole force generator of the present invention.
Figure 7:
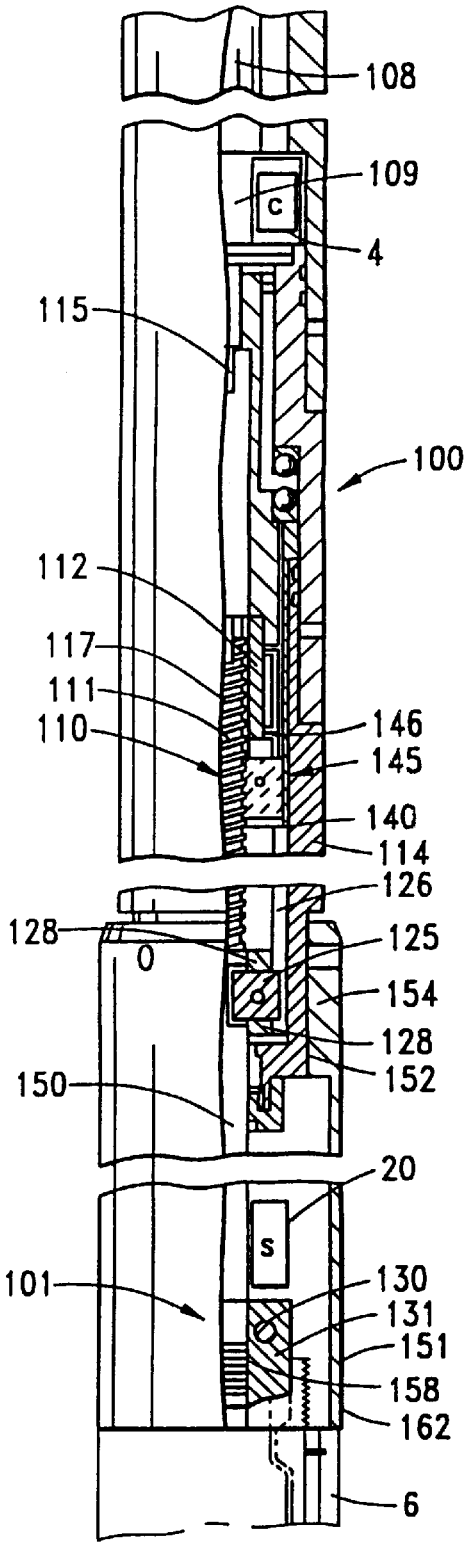

FIGS. 6 and 7 illustrate in partial vertical section upper and lower portions of a particular implementation of a downhole longitudinal force generator tool 100 constructed in accordance with the present invention. Tool 100 includes a working assembly, indicated generally at 101, and a power assembly, indicated generally at 102. Power assembly 102 includes a housing assembly 104 which comprises suitably shaped and connected generally tubular housing members. An upper portion of housing assembly 104 includes an appropriate mechanism to facilitate coupling of housing 104 to a conveying member such as slickline, coiled tubing, or possibly wireline. Other mechanisms for coupling into a pipe or tubing string can also be implemented, for example. Housing assembly 104 also includes a selectively replaceable clutch housing 114 as will be described later herein, which forms a portion of a clutch assembly 145.

Power assembly 102 includes a self-contained power source, eliminating the need for power to be supplied from an exterior source, such as a source at the surface. A preferred power source comprises a battery assembly 106. In one implementation, battery assembly 106 comprises a pack of eighteen C-cell type alkaline batteries.

Connected with power assembly 102 is the force generating and transmitting assembly. The force generating and transmitting assembly of this implementation includes a direct current (DC) electric motor 108, coupled through a gearbox 109, to a jackscrew assembly 110. A plurality of activation mechanisms 121, 122 and 123, as will be described, can be electrically coupled between battery assembly 106 and electric motor 108.

Electric motor 108 may be of any suitable type. One example is a motor operating at 7500 revolutions per minute (rpm) in unloaded condition, and operating at approximately 5000 rpm in a loaded condition, and having a horsepower rating of approximately 1/30th of a horsepower. In this implementation, motor 108 is coupled through the gearbox 109 which provides approximately 5000:1 gear reduction. Gearbox 109 is coupled through a conventional drive assembly 115 to jackscrew assembly 110.

The jackscrew assembly 110 includes a threaded shaft 111 which moves longitudinally, at least initially, in response to rotation of a sleeve assembly 112. In this implementation, threaded shaft 111 is a five pitch shaft. Threaded shaft 111 includes a threaded portion 117, and a generally smooth, polished lower extension 150. Threaded shaft 111 further includes a pair of generally diametrically opposed keys 125 that cooperate with a clutch block 128 which is coupled to threaded shaft 111.

Clutch housing 114 includes a pair of diametrically opposed keyways 126 which extend along at least a portion of the possible length of travel. Keys 125 extend radially outwardly from threaded shaft 111 through clutch block 128 to engage each of keyways 126 in clutch housing 114 thereby preventing rotation of threaded shaft 111 relative to housing 114.

Rotation of sleeve assembly 112 in one direction causes threaded shaft 111 and clutch block 128 to move longitudinally upwardly relative to housing assembly 114 if the shaft 111 is not at its uppermost limit (if the shaft 111 is not at its lowermost position and the clutch assembly is coupled, rotation of the sleeve assembly 112 in the opposite direction moves the shaft 111 downwardly relative to the housing 114). Above a certain level within clutch housing 114, as indicated generally at 140, clutch housing 114 includes a relatively enlarged internal diameter bore 146 such that moving clutch block 128 above level 140 removes the outwardly extending key 125 from being restricted from rotational movement. Accordingly, continuing rotation of sleeve or collar assembly 112 causes longitudinal movement of threaded shaft 111 until clutch block 128 rises above level 140, at which point rotation of sleeve assembly 112 will result in free rotation of threaded shaft 111. By virtue of this, clutch assembly 145 serves as a safety device to prevent burn-out of the electric motor, and also serves as a stroke limiter.

The tool 100 of FIGS. 6 and 7 can incorporate one or more discrete activation assemblies, separate from or part of the controller 4 whose other components are located such as indicated generally in FIG. 7. The activation assemblies enable the jackscrew 110 to operate upon the occurrence of one or more predetermined conditions. This can implement the FIG. 4 depicted decision of whether an operation event has occurred. This control is particularly desirable when the tool is employed to run a lock as the activation assemblies help ensure that the lock is not inadvertently set at an improper location in the tubing string.

One depicted activation assembly is timing circuitry 121 of a type known in the art. Timing circuitry is adapted to provide a signal to the controller 4 in FIG. 7 after passage of a predetermined amount of time. Further, the tool 100 can include an activation assembly including a pressure-sensitive switch 122 of a type generally known in the art which will provide a control signal once the switch 122 reaches a depth at which it encounters a predetermined amount of hydrostatic pressure within the tubing string. Still further, the tool 100 can include an accelerometer 123, sensitive to vertical motion of the tool 100. Accelerometer 123 can be combined with timing circuitry 121 such that when motion is detected by the accelerometer 123, the timing circuitry 121 is reset. If so configured, the activation assembly operates to provide a control signal after the accelerometer 123 detects that the tool 100 has remained substantially motionless within the well for a predetermined amount of time.

Also depicted in FIG. 7 is the working assembly 101. Working assembly 101 includes an actuation assembly 151 which is coupled through housing assembly 104 to be movable therewith. actuation assembly 151 includes an outer sleeve member 154 which is threadably coupled at 152 to housing assembly 104. Working assembly 101 also includes a connecting sub 131 which is threadably coupled at 158 to a lower end of the otherwise polished portion 150 of threaded shaft 111. Connecting sub 131 facilitates connecting to the operated device 6, such as through shear pins 130. Shear pins 130 are adapted to shear and disconnect the device 6 from the tool 100 upon application of a predetermined shear load. The predetermined shear load should generally correspond to an amount at least slightly greater than that required to operate the device 6. When the tool 100 is coupled through engagement of shear pin 130 with connecting sub 131 and the operated device 6, the placement of outer sleeve 154 will be adjusted such that the lower proximate end 162 of sleeve 154 contacts an outer body of the operated device 6.

In further regard to the foregoing, and for all other purposes pertaining to the present invention disclosed and claimed herein, U.S. Pat. No. 5,492,173 to Kilgore et al. is incorporated herein by reference.

The method of the present invention, whether used with the implementation of FIGS. 6 and 7 or otherwise, provides a linear force in an oil or gas well in a manner apparent from the foregoing description of the preferred embodiments of the downhole force generator. More explicitly, however, the method comprises sensing in the well with a detector a parameter responsive over a continuum to changes in a selected operating condition in the well. This includes generating with the detector electrical signals representing the sensed parameter. For example, any of the sensors 20 can be used to perform this step. As a particular example, the sensor 20*a* monitors the translational distance or movement of the translational member 14 which causes position change between two displacement extremes. In response to a detected position, the sensor 20*a* generates an electrical signal that is provided to the microcontroller 18.

The method of the present invention further comprises actuating the microcontroller to run a predetermined program stored in the microcontroller. The microcontroller is located in the well and connected to the detector in the well as described above with regard to the microcontroller 18 and any of the sensors 20. The method also includes running the program to obtain a specific state of the selected operating condition represented within the continuum of the sensed parameter. For the above translation sensing example, the specific state would be a particular desired position which is within the continuum of positions that can be sensed by the respective sensor 20*a*.

Actuating the microcontroller and running the program include connecting the power source disposed in the well with the microcontroller to initiate continuous linear movement of a first body relative to a second body, wherein the first and second bodies are disposed in the well with the microcontroller and the power source. For the illustrated implementation of FIGS. 6 and 7, this includes connecting the power source 106 to the motor 108 so that the motor 108 rotates the sleeve assembly 112 to move the shaft 111. As this occurs, the microcontroller continuously processes electrical signals received from the detector and determines where within the continuum the sensed parameter is. For the above example, this means monitoring the position as sensed by the sensor 20*a*. When it is determined that the sensed parameter is at the point in the continuum corresponding to the specific state of the selected operating condition (e.g., when the sensed position equals the desired position), the running program causes the disconnecting of the power source to stop the linear movement of the first body relative to the second body (e.g., the power source 106 is disconnected from energizing the motor 108).

To allow the movement of the first body relative to the second body to generate sufficient force to operate the device 6, the method further comprises fixing the second body in position relative to the well or relative to an object (typically the device 6) in the well as explained above in the description of the apparatus of the present invention.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A selectably conveyable downhole longitudinal force generator, comprising:

a longitudinal force generating and transmitting assembly adapted to be moved into a well, the assembly including a mechanism to facilitate coupling to a conveying member selected from the group consisting of a slickline, a wireline, and a coiled tubing; and a controller adapted to be moved into the well and connected to the longitudinal force generating and transmitting assembly, the controller including a memory containing a program having data to control the longitudinal force generating and transmitting assembly across a continuum to obtain any desired operating condition in the well, wherein the data defines any of three or more states of the desired operating condition or any of three or more values of the desired operating condition.

2. A downhole longitudinal force generator as defined in claim 1, further comprising a sensor responsive to the desired operating condition in the well, the sensor connected to the controller.

3. A downhole longitudinal force generator as defined in claim 2, further comprising a self-contained power source adapted to be moved into the well, wherein the power source provides electrical power to at least one of the longitudinal force generating and transmitting assembly and the controller.

4. A downhole longitudinal force generator as defined in claim 2, further comprising a self-contained power source adapted to be moved into the well, wherein the power source provides electrical power to both the longitudinal force generating and transmitting assembly and the controller.

5. A downhole longitudinal force generator as defined in claim 1, further comprising a self-contained power source adapted to be moved into the well, wherein the power source provides electrical power to at least one of the longitudinal force generating and transmitting assembly and the controller.

6. A downhole longitudinal force generator as defined in claim 1, further comprising a self-contained power source adapted to be moved into the well, wherein the power source provides electrical power to both the longitudinal force generating and transmitting assembly and the controller.

7. A downhole longitudinal force generator as defined in claim 1, wherein the longitudinal force generating and transmitting assembly includes:

an electric motor including a rotor, the motor responsive to control from the controller; and a jackscrew assembly including:

a rotational member connected to the rotor; and a translational member engaged with the rotational member such that rotation of the rotational member moves the translational member longitudinally relative to the rotational member.

8. A downhole longitudinal force generator as defined in claim 7, further comprising a sensor connected to the controller, wherein the sensor senses the position of the translational member relative to the rotational member.

9. A downhole longitudinal force generator as defined in claim 7, further comprising a sensor connected to the controller, wherein the sensor senses the position of a device connected to the translational member.

10. A downhole longitudinal force generator as defined in claim 7, further comprising a sensor connected to the controller, wherein the sensor senses a condition responsive to the position of the translational member relative to the rotational member.

11. A downhole longitudinal force generator as defined in claim 10, wherein the condition sensed is an environmental parameter.

12. A downhole longitudinal force generator as defined in claim 7, further comprising a sensor connected to the controller, wherein the sensor senses a condition responsive to the position of a device connected to the translational member.

13. A downhole longitudinal force generator as defined in claim 12, wherein the condition sensed is an environmental parameter.

14. A downhole longitudinal force generator as defined in claim 7, further comprising a self-contained power source adapted to be moved into the well, wherein the power source provides electrical power to at least one of the motor and the controller.

15. A downhole longitudinal force generator as defined in claim 7, further comprising a self-contained power source adapted to be moved into the well, wherein the power source provides electrical power to both the motor and the controller.

16. A downhole longitudinal force generator as defined in claim 7, wherein the controller is adapted to operate the motor such that the translational member is movable in either of two directions relative to the rotational member.

17. A downhole longitudinal force generator as defined in claim 1, wherein the memory is programmable at the surface of the well.

18. A downhole longitudinal force generator as defined in claim 1, wherein the memory is programmable in the well.

19. A downhole force generator to operate a choke variable to states between a fully open state and a fully closed state, comprising:

a conveying member selected from the group consisting of a slickline, a wireline, and a coiled tubing;

a force generating and transmitting assembly connected at one end to the choke and at another end to the conveying member;

a sensor to sense a condition in the well related to the degree to which the choke is open or closed; and a controller connected to the force generating and transmitting assembly and to the sensor, the controller including a memory having a program with data or instructions to define in the controller values corresponding to values represented by signals generated by the sensor in relation to the actual state of the choke and to program the controller to operate the force generating and transmitting assembly in response to the data or instructions and the signals from the sensor.

* * * * *